US006812895B2

(12) United States Patent
Anderson et al.

(10) Patent No.: US 6,812,895 B2
(45) Date of Patent: Nov. 2, 2004

(54) RECONFIGURABLE ELECTROMAGNETIC PLASMA WAVEGUIDE USED AS A PHASE SHIFTER AND A HORN ANTENNA

(75) Inventors: Ted Anderson, Niskayuna, NY (US); Igor Alexeff, Oak Ridge, TN (US)

(73) Assignee: Markland Technologies, Inc., Ridgefield, CT (US)

( * ) Notice: Subject to any disclaimer, the term of this patent is extended or adjusted under 35 U.S.C. 154(b) by 0 days.

(21) Appl. No.: 09/790,327

(22) Filed: Feb. 21, 2001

(65) Prior Publication Data

US 2001/0033207 A1 Oct. 25, 2001

Related U.S. Application Data

(63) Continuation-in-part of application No. 09/543,031, filed on Apr. 5, 2000, now Pat. No. 6,624,719.

(51) Int. Cl.[7] ..... H01Q 13/02; H01P 1/18

(52) U.S. Cl. ..... 343/701; 343/786; 333/157; 333/99 PL

(58) Field of Search ..... 333/99 PL, 157; 343/701, 786

(56) References Cited

U.S. PATENT DOCUMENTS

| | | | | |
|---|---|---|---|---|
| 2,557,961 A | | 6/1951 | Goldstein et al. | |
| 2,641,702 A | * | 6/1953 | Cohen et al. | 393/701 |
| 3,155,924 A | * | 11/1964 | Kaufman et al. | 333/99 PL |
| 3,372,394 A | * | 3/1968 | Kaufman | 343/754 |
| 3,404,403 A | | 10/1968 | Vallese et al. | |
| 3,634,767 A | | 1/1972 | Roeder et al. | |
| 3,719,829 A | | 3/1973 | Vaill | |
| 3,779,864 A | | 12/1973 | Kaw et al. | |
| 3,914,766 A | | 10/1975 | Moore | |
| 4,001,834 A | | 1/1977 | Smith | |
| 4,028,707 A | | 6/1977 | Young et al. | |
| 4,062,010 A | | 12/1977 | Young et al. | |
| 4,090,198 A | | 5/1978 | Canty et al. | |
| 4,347,512 A | | 8/1982 | Sweeney | |
| 4,473,736 A | | 9/1984 | Bloyet et al. | |
| 4,574,288 A | | 3/1986 | Sillard et al. | |
| 4,611,108 A | | 9/1986 | Leprince et al. | |
| 4,989,013 A | | 1/1991 | Smith, II et al. | |
| 5,175,560 A | | 12/1992 | Lucas et al. | |
| 5,546,096 A | | 8/1996 | Wada | |
| 5,594,456 A | | 1/1997 | Norris et al. | |
| 5,963,169 A | * | 10/1999 | Anderson et al. | 343/701 |
| 5,990,837 A | | 11/1999 | Norris et al. | |
| 6,046,705 A | | 4/2000 | Anderson | |

OTHER PUBLICATIONS

"A Theoretical and Experimental Study of a Microwave Plasma Closing Switch", Weng Lock Kang, Mark Rader and Igor Alexeff, UTK Plasma Science Laboratory, Department of Electrical and Computer Engineering, University of Tennessee, Knoxville, TN, p. 41P03.

* cited by examiner

*Primary Examiner*—Benny T. Lee
(74) *Attorney, Agent, or Firm*—Thorpe North & Western, LLP

(57) ABSTRACT

Phase shifting plasma electromagnetic waveguides and plasma electromagnetic coaxial waveguides, as well as plasma waveguide horn antennas, each of which can be reconfigurable, durable, stealth, and flexible are disclosed. Optionally, an energy modifying medium to reconfigure the waveguide such that electromagnetic waves of various wavelengths or speeds can be propagated directionally along the path can be used. Similarly, these waveguides may be modified into coaxial configurations.

66 Claims, 6 Drawing Sheets

RECONFIGURABLE ELECTROMAGNETIC PLASMA WAVEGUIDE USED AS A PHASE SHIFTER AND A HORN ANTENNA

This application is a continuation-in-part of U.S. patent application Ser. No. 09/543,031 issued on Apr. 5, 2000 now U.S. Pat. No. 6,624,719, issued Sep. 23, 2003.

FIELD OF THE INVENTION

The present invention is drawn to phase shifting plasma electromagnetic waveguides and plasma electromagnetic coaxial waveguides that are reconfigurable, durable, stealth compatible, and flexible. Additionally, various plasma waveguide horn antennas are also disclosed.

BACKGROUND OF THE INVENTION

A waveguide is generally configured such that current and voltage distributions can be represented by one or more traveling waves, usually in the same direction. In other words, the traveling wave patterns in current and voltage are generally uniform.

A waveguide can be likened unto a coaxial line having the central conductor removed. These waveguides, despite the absence of the central conductor, are still capable of carrying higher frequency electromagnetic waves. Therefore, an important use of waveguides in general is for the transmission of high frequency power, e.g., coupling a high-frequency oscillator to an antenna. Although high frequencies may be transmitted along coaxial cable, a waveguide is generally better than coaxial lines for transmitting large amounts of high frequency signal. If the goal is to transmit lower frequency electromagnetic waves, coaxial lines are generally better. However, only a maximum amount of power may be transmitted along a coaxial line due to the breakdown of the insulation (solid or gas) between the conductors. Additionally, energy is often lost in the insulating material that supports the center conductor.

Whether dealing with metal waveguides or metal coaxial lines, there are serious limitations as to what frequency of waves may be propagated. This is in part due to the material that has been traditionally used to in the construction of waveguides. For example, since metal has fixed properties, a metal waveguide is only capable of propagating very specific signals. This is likewise true to some extent with coaxial cables or lines.

In addition, horn antennas have been widely used as a feed element for large radio astronomy, satellite tracking, and communications dishes found installed throughout the world. With horns, in addition to their utility for feeding reflectors or lenses, they are commonly used as elements in phased arrays, and can be used as a universal standard for calibration and gain measurements of other high-gain antennas. The widespread use of the horn antenna stems from its simplicity in construction, ease of excitation, versatility, large gain, and preferred overall performance. Such horns can take many forms including E-plane horns, H-plane horns, pyramidal horns, corrugated horns, aperture-matched horns, multimode horns (such as the diagonal horn and dual mode conical horns), dielectric-loaded horns, monopulse horns, and phase center horns. Often, a horn antenna is at the terminal end of a waveguide wherein the waveguide is flared to form the horn shape.

Gas has been used as an alternative conductor to metal in various applications. In fact, in U.S. Pat. No. 5,594,456, a gas filled tube coupled to a voltage source for developing an electrically conductive path along a length of the tube is disclosed. The path that is created corresponds to a resonant wavelength multiple of a predetermined radio frequency. Though the emphasis of that patent is to transmit short pulse signal without trailing residual signal, the formation of a conductive path between electrodes in a gas medium is also relevant to other applications.

Based upon what is known about the prior art, there is a need to provide plasma waveguides, plasma horn antennas, and plasma coaxial waveguides that are capable of propagating electromagnetic waves in a desired direction or along a desired path. Not only would these waveguides and coaxial waveguides be reconfigurable with respect to the range of signal that could be propagated, e.g., speed, wavelength, etc., but these waveguides could also be designed to be more stealth, durable, and flexible than traditional metal waveguides and coaxial lines.

SUMMARY OF THE INVENTION

The present invention is drawn to various waveguides and coaxial waveguides which utilize plasma within an enclosed chamber for the conductive material. Specifically, a phase shifting plasma electromagnetic waveguide is disclosed comprising an elongated non-conductive enclosure defining a propagation path for directional electromagnetic wave propagation; a composition contained within the enclosure capable of forming a plasma, wherein the plasma has a skin depth along a surface within the enclosure such that the electromagnetic waves penetrate the skin depth and are primarily propagated directionally along the path; an energy source to form the plasma; and an energy modifying medium to modify the density of the plasma such that electromagnetic waves of various speeds may be propagated directionally along the path. In one embodiment, the enclosure further comprises a first open end and a second open end, wherein the first open end and the second open end are connected by a channel. The channel can be configured along the direction of wave propagation such that the electromagnetic waves penetrate the skin depth and travel within the channel. When an open channel is present, an optional second enclosure can be placed within the channel. Such a combination provides a phase shifting coaxial waveguide. The second enclosure preferably contains a plasma as well, though other structures such as metal can be used instead of a plasma containing enclosure.

Alternatively, a plasma electromagnetic waveguide horn antenna is disclosed comprising an elongated non-conductive enclosure defining a propagation path for directional electromagnetic wave propagation; a horn antenna structure electromagnetically coupled to the enclosure for emitting or receiving electromagnetic waves; a composition contained within the elongated enclosure capable of forming a plasma, wherein the plasma has a skin depth along a surface within the enclosure such that the electromagnetic waves penetrate the skin depth and are primarily propagated directionally along the path in the direction of the horn antenna; and an energy source to form the plasma.

DESCRIPTION OF THE DRAWINGS

In the accompanying drawings which illustrate embodiments of the invention.

DETAILED DESCRIPTION OF THE INVENTION

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

It must be noted that, as used in this specification and the appended claims, singular forms of "a," "an," and "the" include plural referents unless the content clearly dictates otherwise.

The word "between" when used in the context of coaxial waveguides is intended to include not only the space between two waveguide elements or enclosures, but also any skin depth that is penetrated by the electromagnetic wave being propagated.

Figure 1:
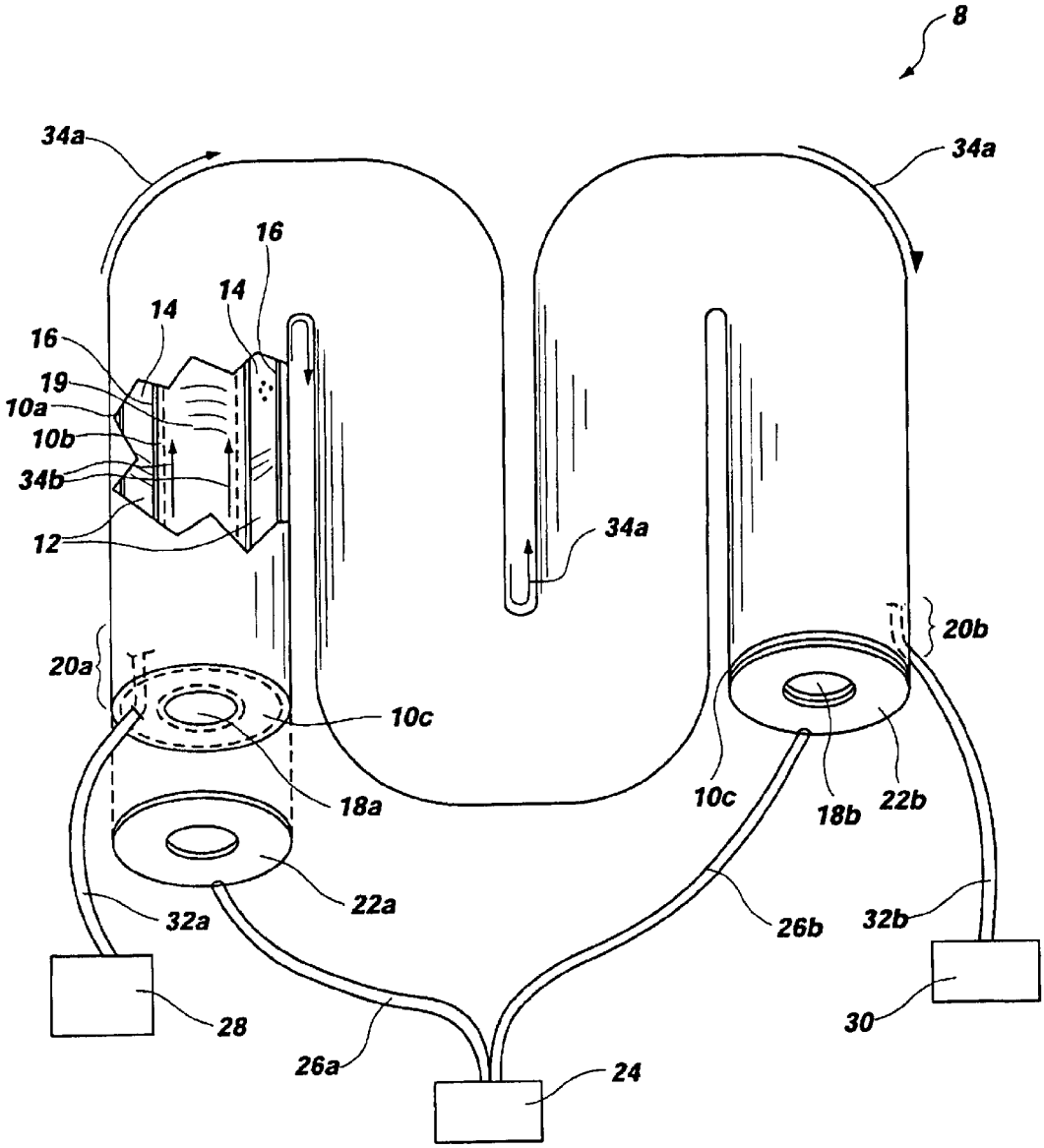
FIG. 1 is a schematic drawing of a folded annular plasma waveguide.

Referring to FIG. 1, a schematic drawing of a folded annular plasma waveguide 8 is depicted. Outer wall 10*a*, inner wall 10*b*, and end walls 10*c* surround the enclosure 12 which contains a composition 14 capable forming a plasma skin depth 16 when the composition 14 is energized. A first open end 18*a* and a second open end 18*b* are connected by a channel or hollow 19. Electromagnetic waves may either be propagated within the hollow 19 along the inner wall 10*b* and/or along the outer wall 10*a*, as long as a plasma skin depth 16 is present along the inner wall 10*b* and/or the outer wall 10*a* respectively.

The plasma waveguide 8 propagates electromagnetic waves between a first end 20*a* and a second end 20*b*. However, it would be apparent to one skilled in the art that the electromagnetic waves could be propagated from the second end 20*b* to the first end 20*a*. Alternatively, one could propagate electromagnetic waves in both directions, i.e., along the outer wall 10*a* in one direction and along the inner wall 10*b* in the other direction.

The composition 14 is energized to form a plasma skin depth 16 by a pair of electrodes 22*a*,22*b* which may be configured as shown, i.e., ring shape electrodes. The electrodes 22*a*,22*b* are energized by a power source 24. Power is respectively carried to the electrodes 22*a*,22*b* by a pair of conductors 26*a*,26*b*. The electrodes 22*a*,22*b* provide a voltage differential to activate the composition 14 to form a plasma skin depth 16. Though electrodes are used in this embodiment, the composition 14 could be energized to form a plasma skin depth 16 by other energizing mediums including fiber optics, high frequency signal, lasers, RF heating, electromagnetic couplers, and other mediums known by those skilled in the art.

Once the composition 14 is energized to form a plasma skin depth 16 within the enclosure 12 (along the outer wall 10*a* and/or inner wall 10*b*), electromagnetic signal may be propagated along a first path 34*a* along the outer wall 10*a* and/or a second path 34*b* along the inner wall 10*b* through the hollow 19. First, a signal is generated by a signal generator 28 which is put in electromagnetic contact with the plasma skin depth 16 by a first transport medium 32*a*. The electromagnetic wave then begins its propagation from the first end 20*a* to the second end 20*b*. The electromagnetic wave is then propagated along the outer wall 10*a* or the inner wall 10*b*, depending on how the transport medium 32*a*, the inner and outer wall 10*a*,10*b*, and/or the plasma skin depth 16 is configured. If the plasma skin depth 16 is along the outer wall 10*a*, then the electromagnetic waves will follow the first path 34*a*. If the plasma skin depth 16 is along the inner wall 10*b*, then the electromagnetic waves will follow the second path 34*b*. The electromagnetic wave penetrates the plasma skin depth 16 which acts to bind the electromagnetic wave to one or both walls 10*a*,10*b* in the direction of the first or second path 34*a*,34*b*. Once the electromagnetic wave reaches the second end 20*b*, a second transport medium 32*b* transports the signal to the signal receiver 30. By altering the plasma skin depth 16 or the density of the plasma, phase shifting can be effectuated. In other words, continuous waves or short pulse waves of different speeds can be propagated along the same waveguide by altering the density of the plasma.

Figure 2:
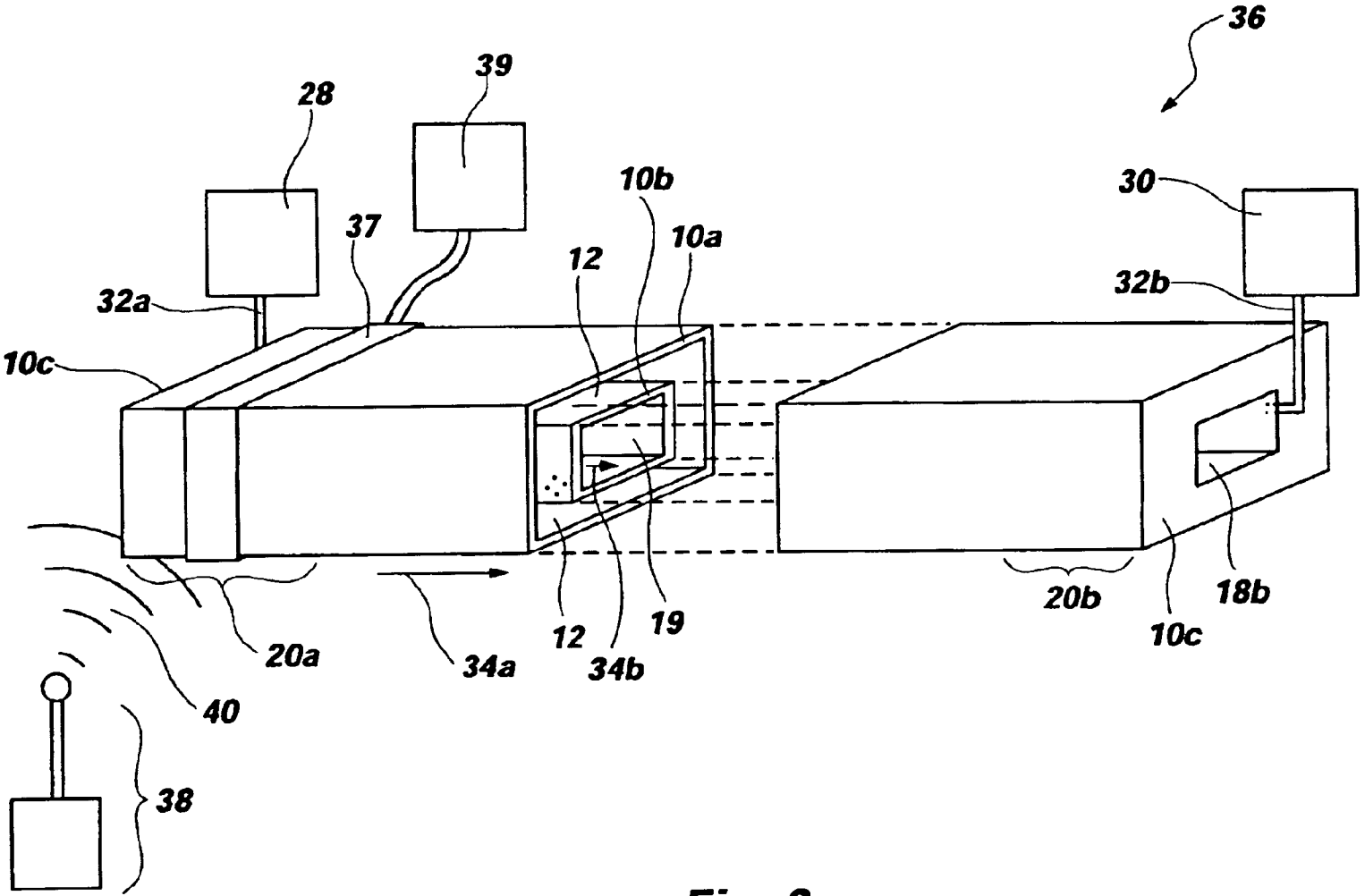
FIG. 2 is a schematic drawing of a rectangular plasma waveguide with a channel or hollow through the center in the direction of the electromagnetic wave propagation path.

Referring now to FIG. 2, a rectangular hollow plasma waveguide 36 is depicted. A section has been cut away for illustrative purposes (shown by dotted lines). The rectangular hollow plasma waveguide 36 is comprised of outer walls 10*a*, inner walls 10*b*, and end walls 10*c*. The walls 10*a*,10*b*, 10*c* define an enclosure 12 which contains a composition 14 capable of forming a plasma skin depth (not shown) along a surface within the enclosure 12. Again, a first open end (not shown) is connected to a second open end 18*b* by a hollow 19. The waveguide 36 has a first end 20*a* and a second end 20*b*. The signal generator 28 is connected to the plasma skin depth (not shown) by a transport medium 32*a*. In this embodiment, electromagnetic waves are propagated along the inner wall 10*b* in the direction of the second path 34*b* which is through the hollow 19. Additionally, electromagnetic waves can be propagated along the first path 34*a* which coincides with wall 10*a*. The signal receiver 30 receives the electromagnetic wave signal via a second transport medium 32*b* which is also electromagnetically coupled to the plasma skin depth (not shown).

As can be seen by the FIG. 2, there are no electrodes present in this embodiment for exciting the composition 14 to form a plasma skin depth. In this embodiment, high frequency signal 40 generated from a high frequency wave oscillator 38 is used to excite the composition 14 to form a plasma skin depth along a surface within the enclosure 12. Alternatively, an electromagnetic coupler 37 is shown that is powered by power source 39. The electromagnetic coupler 37 can also be used to form a plasma skin depth. In yet another embodiment, the signal generator 28 can also act as the energy source to form the plasma. In any of the these embodiments or others, by altering the properties of the plasma, phase shifting can be carried out. Additionally, electromagnetic waves of different wavelengths can be propagated along the same waveguide structure (aside from the altered plasma density or skin depth).

Figure 3:
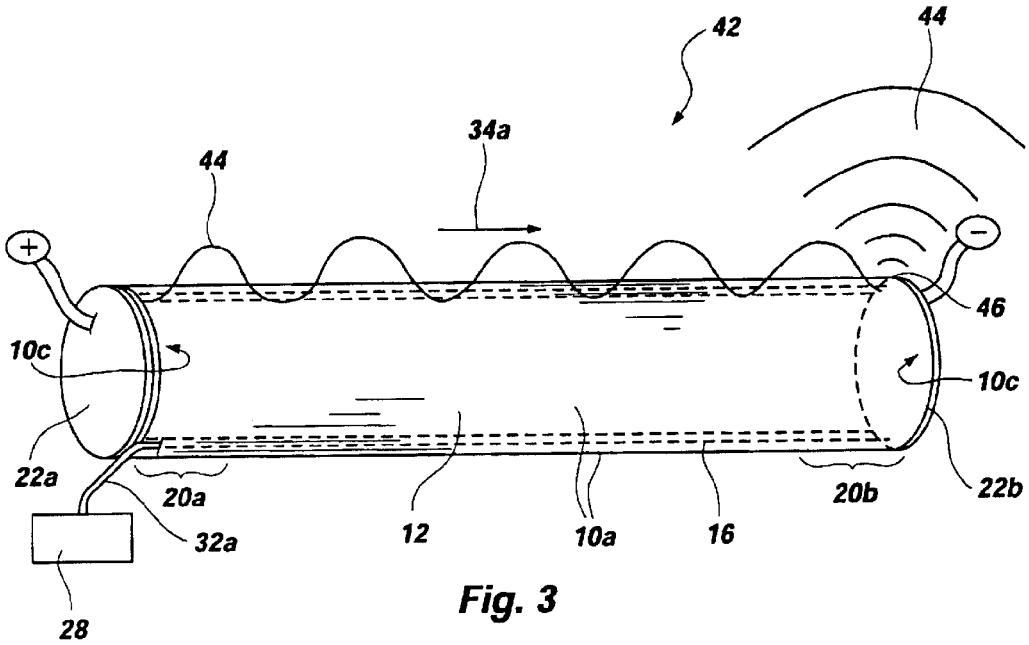
FIG. 3 is a schematic drawing of a cylindrical enclosure structure which may be used as a plasma waveguide/antenna combination where electromagnetic waves are propagated along the outermost diameter and are radiated at a discontinuity.

Referring now to FIG. 3, a cylindrical waveguide 42 is depicted. This particular waveguide does not have a hollow through the center as was shown in FIG. 1 and FIG. 2. In this embodiment, the enclosure is defined by an outer wall 10*a* and end walls 10*c*. There is no inner wall. The plasma skin depth 16 is primarily formed along a surface within the enclosure 12 along the outer wall 10*a*. Electrodes 22*a*,22*b*, having positive (+) and negative (−) feeds, respectively, are positioned at opposing ends 20*a*,20*b* to energize the composition 14 to form a plasma skin depth 16. Electromagnetic signal 44 generated from the signal generator 28, through a transport medium 32*a*, penetrates the plasma skin depth 16 on the outer wall 10*a* and propagates along the first path 34*a*.

As can be seen by the FIG. 2, there are no electrodes present in this embodiment for exciting the composition 14 to form a plasma skin depth. In this embodiment, high frequency signal 40 generated from a high frequency wave oscillator 38 is used to excite the composition 14 to form a plasma skin depth along a surface within the enclosure 12. Alternatively, an electromagnetic coupler 37 is shown that is powered by power source 39. The electromagnetic coupler 37 can also be used to form a plasma skin depth. In yet another embodiment, the signal generator 28 can also act as the energy source to form the plasma. In any of the these embodiments or others, by altering the properties of the plasma, phase shifting can be carried out. Additionally, electromagnetic waves of different wavelengths can be propagated along the same waveguide structure (aside from the altered plasma density or skin depth).

Referring now to FIG. 3, a cylindrical waveguide 42 is depicted. This particular waveguide does not have a hollow through the center as was shown in FIG. 1 and FIG. 2. In this embodiment, the enclosure is defined by an outer wall 10*a* and end walls 10*c*. There is no inner wall. The plasma skin depth 16 is primarily formed along a surface within the enclosure 12 along the outer wall 10*a*. Electrodes 22*a*,22*b*, having positive (+) and negative (−) feeds, respectively, are positioned at opposing ends 20*a*,20*b* to energize the composition 14 to form a plasma skin depth 16. Electromagnetic signal 44 generated from the signal generator 28, through a transport medium 32*a*, penetrates the plasma skin depth 16 on the outer wall 10*a* and propagates along the first path 34*a*.

Figure 8:
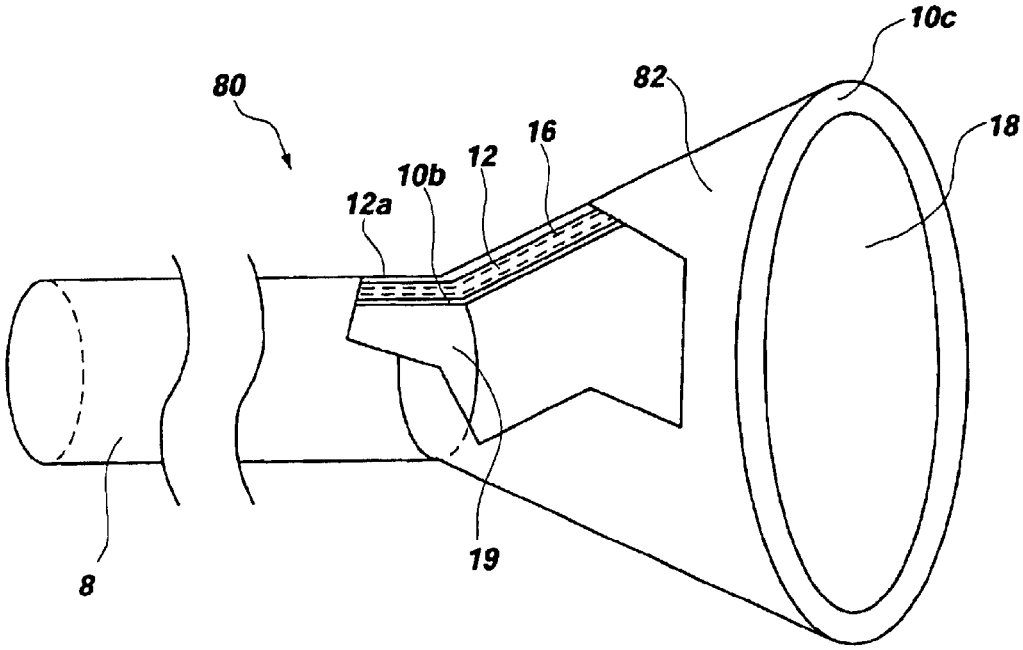
FIG. 8 is a schematic drawing of a plasma waveguide having a conical horn antenna end.

In this embodiment, there need not be a signal receiver because the waveguide itself can be altered to radiate the electromagnetic signal 44. This is done by introducing a discontinuity 46 in the waveguide 42. The discontinuity 46 may be introduced by altering the plasma skin depth 16, the physical structure of the enclosure 12, the impedance, and/or other apparent variables. In one embodiment, the discontinuity can be introduced by a specific structure such as a horn, as shown in FIG. 8 below.

Figure 4:
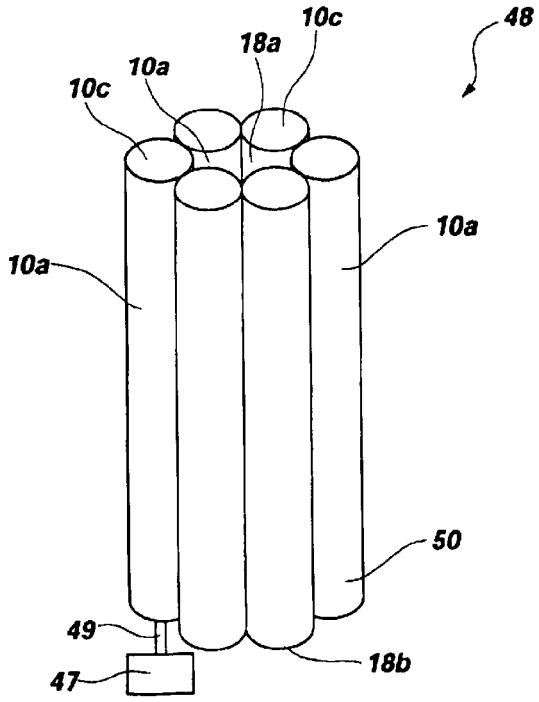
FIG. 4 is a schematic drawing of an enclosure structure having multiple chambers which may be used in a plasma waveguide.

Referring now to FIG. 4, a multi-chambered enclosure 48 for use in a waveguide is shown. Though it is not shown electromagnetically connected to a signal generator or an energy source to form the plasma skin depth, the same principles would apply to this embodiment as applied to the other embodiments. Outer walls 10*a* and end walls 10*c* are shown. A first open end 18*a* is connected to a second open end 18*b* by a hollow (not shown). In this embodiment, the electromagnetic waves could be configured to propagate along the interior of the hollow (not shown) or along the outer most exterior surface 50. In either case, the plasma skin depth (not shown) would be within the enclosures (not shown) along the outer walls 10*a*, as there are no inner walls. Also shown is a fiber optic and/or laser source 47 as well as a transfer medium 49 which can be fiber optic line and/or a laser coupling.

Figure 5:
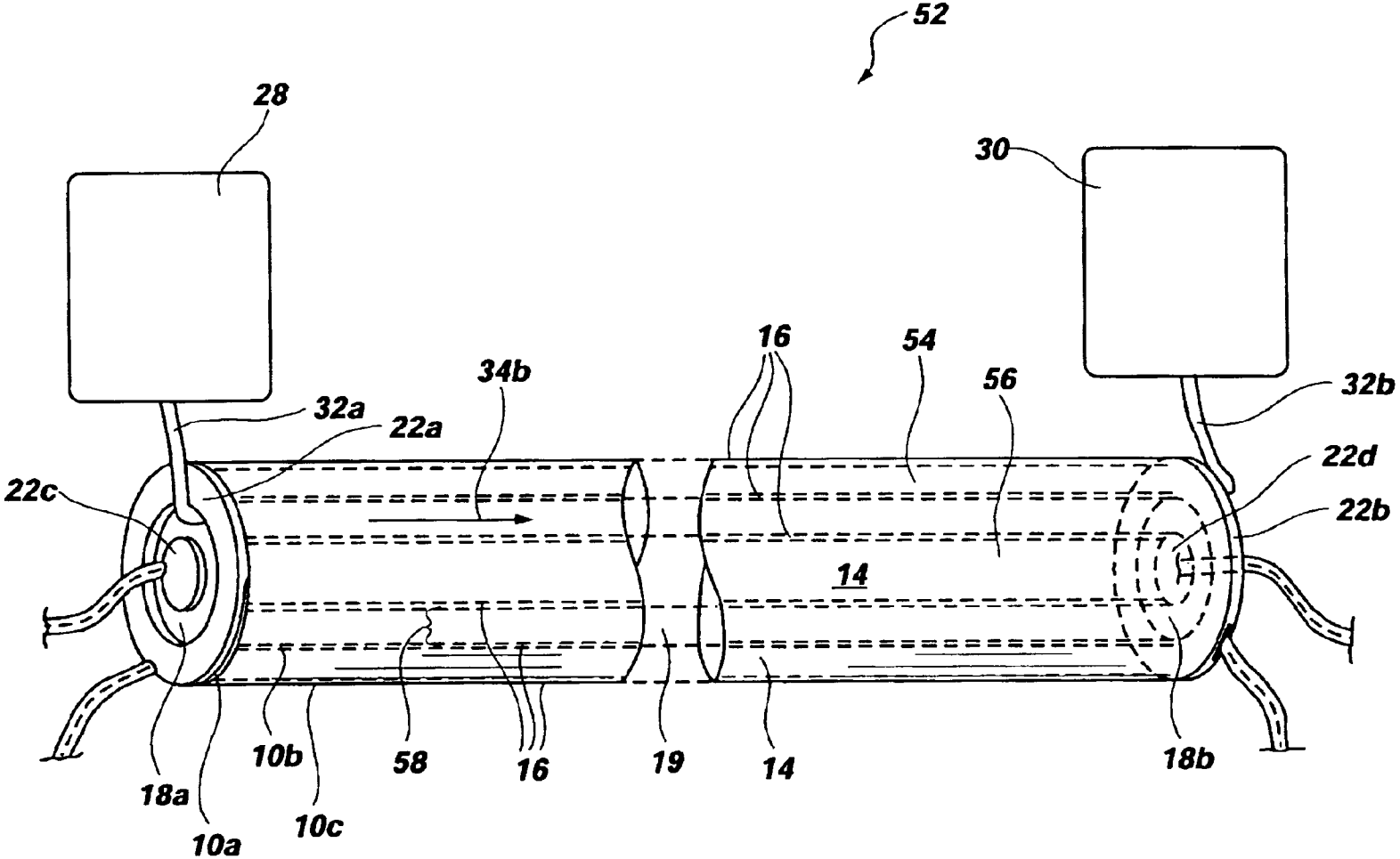
FIG. 5 is a schematic drawing of an annular coaxial plasma waveguide.

Referring now to FIG. 5, an annular coaxial waveguide 52 is shown. The annular coaxial waveguide 52 is comprised of two enclosures. A first enclosure 54 is annular in shape having an outer wall 10*a*, an inner wall 10*b*, and end walls 10*c*. A hollow 19 is positioned between a first open end 18*a* and a second open end 18*b*. A composition 14 is contained within the first enclosure 54 which is capable of forming a plasma skin depth 16 when energized.

A second enclosure 56 is positioned concentrically within the hollow 19 of the first enclosure 54. In this embodiment, the second enclosure 56 is a cylinder, though it could be any shape, e.g., annulus, rectangular, oval, etc. Further, the second enclosure 56 need not be the same length as the first enclosure 54. In this embodiment, it is preferred that the electromagnetic waves propagate in the space 58 that exists between the plasma skin depth 16 of the first enclosure 54 and the plasma skin depth 16 of the second enclosure 56. However, electromagnetic waves may propagate along the outer wall 10*a* of the first enclosure 54 as well, penetrating the plasma skin depth 16 within the outer wall 10*a*.

The composition 14 is energized to form a plasma skin depth 16 by electrodes 22*a*, 22*b*, 22*c*, 22*d* that are powered similarly as discussed in FIG. 1. In this embodiment, the signal generator 28 produces a signal that is transported to the plasma skin depth 16 by a first transport medium 32*a*. The electromagnetic wave propagates along a path 34*c* between the plasma skin depth 16 of the first enclosure 54 and the plasma skin depth 16 of the second enclosure 56. At the end of the path 34*c*, a signal receiver 30 receives the electromagnetic wave information via a second transport medium 32*b*. As is the case with all of the structures shown and described herein, by altering the plasma skin depth 16 or the density of the plasma, phase shifting can be effectuated. In other words, continuous waves or short pulse waves of different speeds can be propagated along the same waveguide by altering the density of the plasma. Additionally, electromagnetic waves of different wavelengths can be propagated along the same waveguide by altering the density of the plasma.

By slightly modifying FIG. 5, another embodiment may be prepared. For example, if the first enclosure 54 were replaced with a metal structure (such as a pipe), and the second enclosure 56 remained unchanged as a plasma chamber, then a hybrid coaxial waveguide may be formed. This hybrid type of waveguide would still be reconfigurable due to the properties of second enclosure 56. However, this waveguide would not maintain its stealth characteristics due to the metal structure. Conversely, the second enclosure 56 could be replaced by a metal structure (such as wire) while maintaining the first enclosure 54 as a chamber for defining the plasma skin depth 16. Again, this type of coaxial waveguide would still be reconfigurable, but would not maintain its stealth characteristics.

Figure 6:
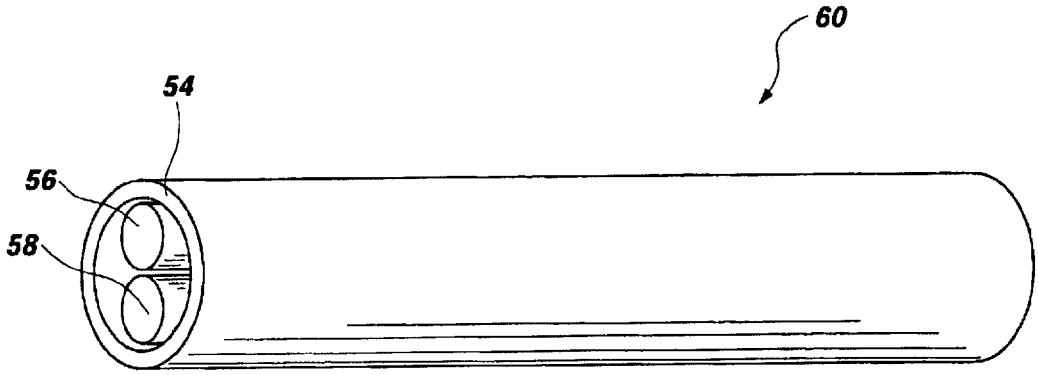
FIG. 6 is a schematic drawing of an annular coaxial enclosure having two cylindrical plasma elements within the hollow of the annular plasma enclosure for use in a modified coaxial plasma waveguide.

Referring now to FIG. 6, a triple element enclosure 60 for use as a coaxial waveguide is shown. This embodiment is similar to the embodiment of FIG. 5 with the exception that there are two cylindrical plasma enclosures 56, 58 within the annular first enclosure 54.

Figure 7:
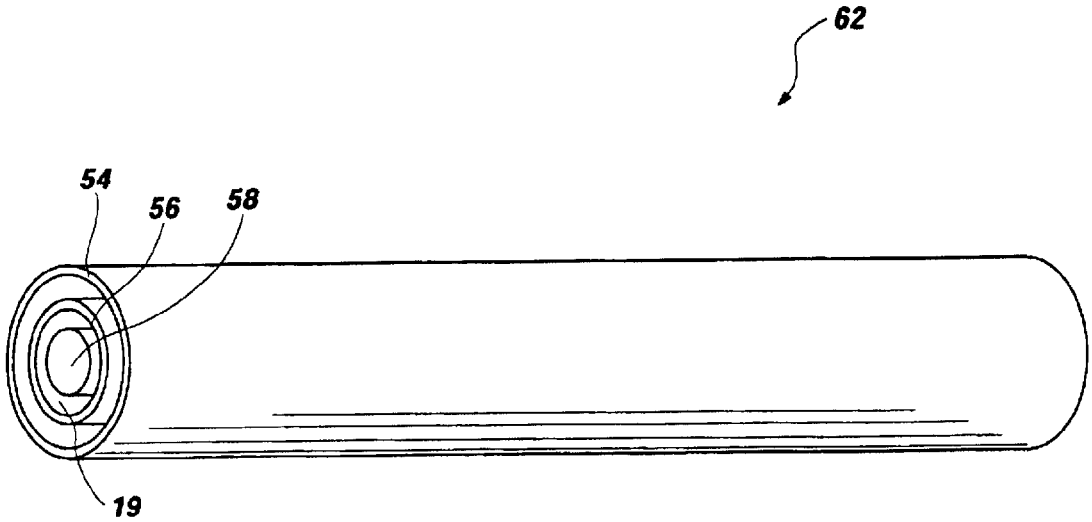
FIG. 7 is a schematic drawing of three enclosures configured concentrically for use in a modified coaxial plasma waveguide.

Referring now to FIG. 7, a concentric triple element enclosure 62 for use as a coaxial waveguide is shown. Again, this embodiment is similar to the embodiment of FIG. 5 with the exception that there are two annular enclosures 54, 58 positioned concentrically and a cylindrical enclosure 56 positioned within the hollow 19 of the innermost annular enclosure 58. One possible application for the concentric triple element enclosure 62 would be to configure the energy source (not shown) such that electromagnetic waves would travel in one direction in one space and return in the second space. To do this, the energy source (not shown) such as electrodes could be configured at one end of the coaxial waveguide. In other words, the electrodes could be configured such that the current would flow in one direction between element 56 and element 58 and returning in the other direction between element 54 and element 58 (in each case, penetrating only the skin depth of the plasma). In one preferred configuration, element 54 could be sealed off at an end that is opposite of the electrodes (not shown) such that no radiation occurs when the propagating electromagnetic waves are transferred from between elements 56, 58 to the elements between 54, 58 (again, penetrating the respective skin depths as described previously).

Referring to FIG. 8, a plasma waveguide horn antenna 80 is shown comprising a plasma waveguide B, such as that shown in the previous figures, and a horn or flared end 82. The combination allows for electromagnetic waves to travel along the plasma waveguide 8, in the direction of the horn 82. Though the horn 82 shown in conical form, any of a number of horn configurations could be used including E-plane horns, H-plane horns, pyramidal horns, corrugated horns, aperture-matched horns, multimode horns (such as the diagonal horn and dual mode conical horns), dielectric-loaded horns, monopulse horns, and phase center horns.

The plasma waveguide horn antenna 80 is comprised of an outer wall 10*a*, inner wall 10*b*, and end walls 10*c* surround the enclosure 12 which contains a composition capable of forming a plasma skin depth 16 when the composition is energized. A first open end (not shown) and a second open end 18*b* are connected by a channel or hollow 19. Electromagnetic waves may either be propagated within the hollow 19 along the inner wall 10*b* and/or along the outer wall 10*a*, as long as a plasma skin depth 16 is present along the inner wall 10*b* and/or the outer wall 10*a* respectively.

The horn 82 portion of the plasma waveguide horn antenna 80 acts to radiate the electromagnetic waves propagated along the plasma waveguide 8 portion of the structure. Though FIG. 8 shows a plasma based horn, the horn can also be constructed of a metallic material as well, as long as the waves can be transferred from the plasma waveguide to the horn structure. An example of an instance where a metal horn might be appropriate for use includes applications where a corrugated horn is desired.

With the above embodiments in mind, a phase shifting electromagnetic waveguide and a phase shifting electromagnetic coaxial waveguide is disclosed. The waveguide is comprised generally of an elongated non-conductive enclosure defining a propagation path. The path generally follows the elongated dimension of the enclosure for directional electromagnetic wave propagation.

Specifically, a phase shifting plasma electromagnetic waveguide is disclosed comprising an elongated non-conductive enclosure defining a propagation path for directional electromagnetic wave propagation; a composition contained within the enclosure capable of forming a plasma, wherein the plasma has a skin depth along a surface within the enclosure such that the electromagnetic waves penetrate the skin depth and are primarily propagated directionally along the path; an energy source to form the plasma; and an energy modifying medium to modify the density of the plasma such that electromagnetic waves of various speeds may be propagated directionally along the path.

The preferred structure of the enclosure is comprised of a first open end and a second open end wherein the first open end and the second open end are connected by a hollow or channel in the direction of wave propagation. In one embodiment, the enclosure is annular in shape. However, other cross-section configurations are also preferred such as rectangular, ellipsoidal, other functional known shapes, and enclosures having a plurality of individual chambers configured to form a hollow. One advantage of utilizing configurations having a hollow through the center is that radiating electromagnetic wave loss is kept to a minimum. By propagating the electromagnetic wave through the open channel or hollow of the enclosure, electromagnetic waves are prevented from escaping into the environment as the waves can only penetrate the skin depth of the plasma. However, these waveguides may also propagate waves along the outermost surface. In fact, a cylindrically shaped waveguide without an open channel or hollow center may also act as a waveguide, though some radiation loss would be difficult to prevent.

When a hollow or channel is present through the plasma waveguide, a second elongated non-conductive enclosure positioned within the channel can be used to provide a plasma coaxial waveguide. The second enclosure can either contain a plasma or can be a conductive structure itself. If the second enclosure contains a plasma, a second composition capable of forming a second plasma must be present in the enclosure. When properly energized, the composition can form a second plasma having a skin depth along a surface of the second enclosure such that the electromagnetic waves penetrate the skin depth within the second enclosure and travel within the channel, i.e., between the skin depth of a first enclosure and the second enclosure. In order to form the plasma, at least one energy source is coupled to the composition to form the plasma within the first enclosure and/or the second enclosure.

As mentioned, the enclosure (and/or the second enclosure if used) should be made from a non-conductive material, and preferably from a material or combinations of materials that are not easily degraded by the plasma. There is also some advantage to using material that is flexible. One advantage includes the ability to deform the diameter by internal or external, positive or negative pressure. Additionally, the use of a flexible material would allow for the waveguides of the present invention to be fed into hard to reach areas. For example, one may be required to insert a waveguide into an area having sharp corners. A flexible material would allow the waveguide to conform to its environment.

A composition, preferably a gas, that is capable of forming a plasma when energized should be substantially contained within the enclosure. Once formed, the plasma can have an appropriate skin depth along a surface of the enclosure. The skin depth acts to prevent electromagnetic waves from radiating from the waveguide. In other words, the electromagnetic waves penetrate the thickness of the skin depth which acts to bind the electromagnetic waves to the surface of the enclosure. Though some radiation loss may occur with the waveguides of the present invention, the electromagnetic waves will primarily adhere to the surface of the enclosure. Preferred gases may be selected from the group consisting of neon, xenon, argon, krypton, hydrogen, helium, mercury vapor, and combinations thereof, though other gasses may be used as is commonly known in the art.

An energy source is used to convert the composition present in the enclosure to a plasma. Typically, the energy source will be in the form of electrodes, lasers, high frequency electromagnetic waves, fiber optics, RF heating, electromagnetic couplers, and/or other known energy sources. In one preferred embodiment, a pair of electrodes in electrical contact with the composition may be used to energize the composition to form a plasma skin depth. Preferably, the electrodes are an anode and a cathode positioned at opposite ends of the path. If the enclosure is annular in shape, ring electrodes are most preferred. However, the use of fiber optics or lasers are other preferred methods of energizing the composition to form the plasma, especially if the goal is to provide a waveguide that is essentially stealth to radar.

The waveguides and coaxial waveguides of the present invention are appropriate for use for both continuous and short pulse applications. Further, with the waveguides and coaxial waveguides of the present invention, the use of an energy modifying medium is also preferred if the waveguide is to be reconfigurable such that electromagnetic waves of various wavelengths may be propagated directionally along the path. For example, by altering the skin depth of the plasma, without changing the geometry of the enclosure, electromagnetic waves having different properties, i.e., wavelength, may be propagated down the same waveguide. Additionally, the plasma waveguides and plasma coaxial waveguides of the present invention can be used to propagate electromagnetic waves of different speeds. Thus, the phase shifting aspect of the present invention can be utilized by altering the skin depth and/or density of the plasma. Metal waveguides do not have this capability because the properties of metals are fixed. The skin depth of the plasma may be altered simply by altering the density of the plasma. Additionally, by altering the parameters of the energy source, i.e., controlling which energizing points are energized if several sources are present, controlling the voltage applied, controlling intensity applied, etc., the waveguide may be reconfigured.

Alternatively, the energy modifying medium can be the addition or removal of composition material, e.g., neutral gas and/or plasma gas, pumped into or out from the chamber of an enclosure. Additionally, the positive or negative pressure can be used to deform the structure. For example, if the enclosure is flexible, the enclosure can deform. This would change the physical shape of the waveguide allowing for different electromagnetic waves to be propagated along the path. Similarly, gas could be removed to deform the diameter of the waveguide as well. If deformation of the chamber is not desired, then changing the pressure of the composition material without deforming the structure would alter the properties of the plasma as well. For example, by decreasing the pressure of the composition within the enclosed chamber, ionization within the chamber may increase. Conversely, by increasing the pressure of the composition, ionization may decrease. Alternatively, by decreasing or increasing the amount of ionizable gas in the enclosure, or by altering the composition in the enclosure, the ionization properties can be altered to achieve a desired effect. These and other modifying mediums or mechanisms apparent to those skilled in the art may be used to reconfigure the waveguides and coaxial waveguides of the present invention.

If one desires to convert the waveguide to an antenna, this may be accomplished by introducing a discontinuity in the waveguide such that the electromagnetic waves are radiated directionally. This would preferably occur with waveguides having external wave propagation, i.e., waves propagating along the most exterior surface of the enclosure, though this is not required. The discontinuity may be introduced in several different forms including a physical aberration, a sudden change in impedance, and/or a change in the skin depth. In one embodiment, a horn can be coupled to the waveguide for radiating or receiving electromagnetic signal.

The waveguides of the present invention are generally electromagnetically connected to a signal generator. This is done by putting the electromagnetic waves generated by the signal generator into contact with the skin depth of the plasma for directional wave propagation along the path. Additionally, if the waveguide is not also acting as the antenna element as describe previously, a signal receiver is preferably connected to the skin depth of the plasma to receive the electromagnetic waves generated by the signal generator and propagated by the waveguide. The signal generator and the signal receiver are generally at opposite ends of the enclosure along the direction of electromagnetic wave propagation.

There are several advantages to using plasma waveguides and plasma coaxial waveguides over conventional waveguides. First, as discussed, plasma waveguides and plasma coaxial waveguides are reconfigurable. In other words, different types of electromagnetic waves may be propagated along these waveguides without a change in the enclosure geometry, i.e., speed, wavelength, etc. Second, plasma waveguides are much more stealth than conventional waveguides. When the waveguide is not propagating, it is invisible to radar. In other words, if the plasma density is decreased enough, or completely depleted, these plasma waveguides become stealth. Additionally, these waveguides may easily be designed to be lightweight, flexible, and highly corrosion resistant.

Regarding the advantage of reconfigurability, the electromagnetic waves are capable of traveling in variable skin depths which depends on the plasma density. When the skin depth is altered by modifying the density of the plasma, the electromagnetic wave that the waveguide is capable of carrying is changed. Thus, by altering the density of the plasma, the waveguide may be reconfigured without altering the physical geometry of the dielectric or non-conductive tubing or other enclosure. Specifically, by increasing the plasma density or ionization, the plasma skin depth is decreased. Conversely, by decreasing the plasma density, the plasma skin depth is increased. Thus, the waveguide may be tuned to match the type of wave that one desires to be propagated. With metal waveguides, the equivalent of the plasma skin depth is fixed and cannot be altered.

The main purpose of these waveguides is to transport waves from one point to the next. In one embodiment, at the terminal location, the electromagnetic waves can be radiated or sent to a signal receiver. In another embodiment, the terminal end can include a horn antenna for radiating or receiving electromagnetic waves. During propagation along the waveguide, the wave will not penetrate the enclosure beyond the skin depth of the plasma, nor will the wave substantially radiate outwardly, as long as there is no discontinuity. This is because the phase speed of the wave is less than the speed of light, preventing any significant radiation.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims and equivalents thereof.

We claim:

1. A phase shifting plasma electromagnetic waveguide, comprising:

a) an elongated non-conductive enclosure defining a propagation path therein for directional electromagnetic wave propagation, wherein a metal sleeve does not surround the enclosure:

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma;

d) an energy modifying medium to modify the density of the plasma such that electromagnetic waves of various speeds may be propagated directionally along the path; and e) a discontinuity in the waveguide such that said electromagnetic waves may be radiated.

2. A phase shifting plasma electromagnetic waveguide as in claim 1 wherein the discontinuity is provided by a structural discontinuity of the enclosure.

3. A phase shifting plasma electromagnetic waveguide as in claim 1 wherein the discontinuity is created by a change in impedance along the propagation path.

4. A phase shifting plasma electromagnetic waveguide as in claim 1 wherein the discontinuity is created by a change in skin depth along the propagation path.

5. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma;

d) an energy modifying medium to modify the density of the plasma such that electromagnetic waves of various speeds may be propagated directionally along the path, wherein the energy modifying medium also alters the skin depth of the plasma.

6. A phase shifting plasma electromagnetic waveguide as in claim 5 wherein the electromagnetic waves are continuous waves.

7. A phase shifting plasma electromagnetic waveguide as in claim 5 wherein the electromagnetic waves are short-pulse waves.

8. A phase shifting plasma electromagnetic waveguide as in claim 5 wherein said enclosure is flexible along directions perpendicular to the path and the energy modifying medium also alters the plasma pressure within the flexible enclosure thereby causing deformation of the enclosure.

9. A phase shifting plasma electromagnetic waveguide as in claim 5 wherein said enclosure is flexible along directions perpendicular to the path.

10. A phase shifting plasma electromagnetic waveguide as in claim 5 wherein the composition is a gas selected from the group consisting of neon, xenon, argon, krypton, hydrogen, helium, mercury vapor, and combinations thereof.

11. A phase shifting plasma electromagnetic waveguide as in claim 5 wherein the energy source comprises a pair of electrodes in electromagnetic contact with the composition.

12. A phase shifting plasma electromagnetic waveguide as in claim 11 wherein the pair of electrodes are an anode and a cathode positioned at opposite ends of the path.

13. A phase shifting plasma electromagnetic waveguide as in claim 5 wherein the energy source is selected from the group consisting of fiber optics, lasers, and electromagnetic couplers electromagnetically coupled to the composition.

14. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma; and d) an energy modifying medium to modify the density of the plasma such that electromagnetic waves of various speeds may be propagated directionally along the path, wherein said enclosure further comprises a first open end and a second open end, said first open end and said second open end being connected by a channel, said channel being configured along the direction of wave propagation such that the electromagnetic waves penetrate the skin depth and travel within the channel.

15. A phase shifting plasma electromagnetic waveguide as in claim 14 further comprising a second elongated non-conductive enclosure positioned within the channel, said second enclosure containing a second composition capable of forming a second plasma, thus forming a plasma coaxial waveguide.

16. A phase shifting plasma electromagnetic waveguide as in claim 15 wherein the electromagnetic waves traveling along the plasma coaxial waveguide are continuous waves.

17. The electromagnetic waveguide of claim 15 wherein said second plasma has a skin depth along a surface of the second enclosure such that the electromagnetic waves penetrate the skin depth within the second enclosure and travel within the channel.

18. The electromagnetic waveguide of claim 15 wherein a single energy source is used to energize the respective composition to thereby form the corresponding plasma within the enclosure and the second enclosure.

19. A phase shifting plasma electromagnetic waveguide as in claim 14 wherein the electromagnetic waves are short-pulse waves.

20. A phase shifting plasma electromagnetic waveguide as in claim 14 wherein the electromagnetic waves are continuous waves.

21. A phase shifting plasma electromagnetic waveguide as in claim 14 wherein said enclosure is flexible along directions perpendicular to the path.

22. A phase shifting plasma electromagnetic waveguide as in claim 14 wherein the composition is a gas selected from the group consisting of neon, xenon, argon, krypton, hydrogen, helium, mercury vapor, and combinations thereof.

23. A phase shifting plasma electromagnetic waveguide as in claim 14 wherein the energy source comprises a pair of electrodes in electromagnetic contact with the composition.

24. A phase shifting plasma electromagnetic waveguide as in claim 23 wherein the pair of electrodes are an anode and a cathode positioned at opposite ends of the path.

25. A phase shifting plasma electromagnetic waveguide as in claim 14 wherein the energy source is selected from the group consisting of fiber optics, lasers, and electromagnetic couplers electromagnetically coupled to the composition.

26. A phase shifting plasma electromagnetic waveguide as in claim 14 wherein said enclosure is flexible along directions perpendicular to the path and the energy modifying medium also alters the plasma pressure within the flexible enclosure thereby causing deformation of the enclosure.

27. A plasma electromagnetic waveguide horn antenna comprising:

a) an elongated non-conductive enclosure defining a propagation path for directional electromagnetic wave propagation;

b) a horn antenna structure electromagnetically coupled to the enclosure for emitting electromagnetic waves;

c) a composition contained within the elongated enclosure capable of forming a plasma, said plasma when formed having a skin depth along a surface within the enclosure such that the electromagnetic waves penetrate the skin depth and are primarily propagated directionally along the path in the direction of the horn antenna; and d) an energy source for energizing the composition to form the plasma.

28. A plasma electromagnetic waveguide horn antenna as in claim 27 wherein the horn antenna comprises an opening that is fluidly connected to the enclosure such that the composition is within both the enclosure and the horn antenna.

29. A plasma electromagnetic waveguide horn antenna as in claim 28 wherein the composition is a gas selected from the group consisting of neon, xenon, argon, krypton, hydrogen, helium, mercury vapor, and combinations thereof.

30. A plasma electromagnetic waveguide horn antenna as in claim 28 wherein the plasma of the horn antenna and the plasma of the elongated enclosure are in fluid communication.

31. A plasma electromagnetic waveguide horn antenna as in claim 27 wherein the horn antenna is selected from the group consisting of E-plane horns, H-plane horns, pyramidal horns, corrugated horns, aperture-matched horns, multimode horns, dielectric-loaded horns, monopulse horns, and phase center horns.

32. A plasma electromagnetic waveguide horn antenna as in claim 27 further comprising a signal generator in electrical contact with the plasma for generating electromagnetic waves to be propagated along the path and toward the horn.

33. A plasma electromagnetic waveguide horn antenna as in claim 27 the electromagnetic waves produced by the signal generator also act as the energy source used to generate the plasma.

34. A plasma electromagnetic waveguide horn antenna as in claim 27 wherein said elongated enclosure is flexible along directions perpendicular to the path.

35. A plasma electromagnetic waveguide horn antenna as in claim 27 wherein the composition is a gas selected from the group consisting of neon, xenon, argon, krypton, hydrogen, helium, mercury vapor, and combinations thereof.

36. A plasma electromagnetic waveguide horn antenna as in claim 27 wherein the energy source is selected from the group consisting of electrodes, fiber optics, lasers, electromagnetic couplers, and high frequency signal generating sources.

37. A plasma electromagnetic waveguide horn antenna as in claim 27 further comprising an energy modifying medium to modify the density of the plasma such that electromagnetic waves of various speeds and wavelengths may be propagated directionally along the path toward the horn antenna.

38. A plasma electromagnetic waveguide horn antenna as in claim 37 wherein the energy modifying medium also alters the skin depth of the plasma.

39. A plasma electromagnetic waveguide horn antenna as in claim 27 wherein the electromagnetic waves are continuous waves.

40. A plasma electromagnetic waveguide horn antenna as in claim 27 wherein the electromagnetic waves are short-pulse waves.

41. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma;

d) an energy modifying medium to modify the density of the plasma such that electromagnetic waves of various speeds may be propagated directionally along the path;

e) a signal generator in electrical contact with the plasma for generating electromagnetic waves to be propagated along the path; and f) a signal receiver in electrical contact with the plasma for receiving the electromagnetic waves generated by the signal generator and propagated along the path, wherein the signal generator and the signal receiver are positioned at opposite ends of the enclosure along the direction of electromagnetic wave propagation.

42. A phase shifting plasma electromagnetic waveguide as in claim 41 wherein said enclosure is flexible along directions perpendicular to the path.

43. A phase shifting plasma electromagnetic waveguide as in claim 41 wherein the composition is a gas selected from the group consisting of neon, xenon, argon, krypton, hydrogen, helium, mercury vapor, and combinations thereof.

44. A phase shifting plasma electromagnetic waveguide as in claim 41 wherein the energy source comprises a pair of electrodes in electromagnetic contact with the composition.

45. A phase shifting plasma electromagnetic waveguide as in claim 44 wherein the pair of electrodes are an anode and a cathode positioned at opposite ends of the path.

46. A phase shifting plasma electromagnetic waveguide as in claim 41 wherein the energy source is selected from the group consisting of fiber optics, lasers, and electromagnetic couplers electromagnetically coupled to the composition.

47. A phase shifting plasma electromagnetic waveguide as in claim 41 wherein the energy modifying medium also alters the density of the plasma.

48. A phase shifting plasma electromagnetic waveguide as in claim 41 wherein said enclosure is flexible along directions perpendicular to the path and the energy modifying medium also alters the plasma pressure within the flexible enclosure thereby causing deformation of the enclosure.

49. A phase shifting plasma electromagnetic waveguide as in claim 41 wherein the electromagnetic waves are continuous waves.

50. A phase shifting plasma electromagnetic waveguide as in claim 41 wherein the electromagnetic waves are short-pulse waves.

51. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma;

d) an energy modifying medium to modify the density of the plasma such that electromagnetic waves of various speeds may be propagated directionally along the path; and e) a signal generator in electrical contact with the plasma for generating electromagnetic waves to be propagated along the path, wherein the electromagnetic waves produced by the signal generator also act as the energy source used to generate the plasma.

52. A phase shifting plasma electromagnetic waveguide as in claim 51 wherein said enclosure is flexible along directions perpendicular to the path.

53. A phase shifting plasma electromagnetic waveguide as in claim 51 wherein the composition is a gas selected from the group consisting of neon, xenon, argon, krypton, hydrogen, helium, mercury vapor, and combinations thereof.

54. A phase shifting plasma electromagnetic waveguide as in claim 51 wherein the electromagnetic waves are continuous waves.

55. A phase shifting plasma electromagnetic waveguide as in claim 51 wherein the electromagnetic waves are short-pulse waves.

56. A phase shifting plasma electromagnetic waveguide as in claim 4 wherein said enclosure is flexible along directions perpendicular to the path and the energy modifying medium also alters the plasma pressure within the flexible enclosure thereby causing deformation of the enclosure.

57. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma; and d) an energy modifying medium to modify the density of the plasma such that electromagnetic waves of various speeds may be propagated directionally along the path, wherein the electromagnetic waves are short-pulse waves.

58. A phase shifting plasma electromagnetic waveguide, comprising:

a) an elongated non-conductive enclosure defining a propagation path therein for directional electromagnetic wave propagation, wherein a metal sleeve does not surround the enclosure;

b) a composition contained within the enclosure capable of forming a plasma, said plasma when formed having a skin depth along a surface within the enclosure such that the electromagnetic waves penetrate the skin depth and are primarily propagated directionally along the path;

c) an energy source for energizing the composition to form the plasma, wherein the energy source generates a high frequency signal;

d) an energy modifying medium to modify the density of the plasma such that electromagnetic waves of various speeds may be propagated directionally along the path.

59. A phase shifting plasma electromagnetic waveguide as in claim 58 wherein the electromagnetic waves are continuous waves.

60. A phase shifting plasma electromagnetic waveguide as in claim 58 wherein said enclosure is flexible along directions perpendicular to the path.

61. A phase shifting plasma electromagnetic waveguide as in claim 58 wherein the composition is a gas selected from the group consisting of neon, xenon, argon, krypton, hydrogen, helium, mercury vapor, and combinations thereof.

62. A phase shifting plasma electromagnetic waveguide as in claim 58 wherein the energy source comprises a pair of electrodes in electromagnetic contact with the composition.

63. A phase shifting plasma electromagnetic waveguide as in claim 62 wherein the pair of electrodes are an anode and a cathode positioned at opposite ends of the path.

64. A phase shifting plasma electromagnetic waveguide as in claim 58 wherein the energy source is selected from the group consisting of fiber optics, lasers, and electromagnetic couplers electromagnetically coupled to the composition.

65. A phase shifting plasma electromagnetic waveguide as in claim 58 wherein the electromagnetic waves are short-pulse waves.

66. A phase shifting plasma electromagnetic waveguide as in claim 58 wherein said enclosure is flexible along directions perpendicular to the path and the energy modifying medium also alters the plasma pressure within the flexible enclosure thereby causing deformation of the enclosure.

* * * * *